US009156582B2

(12) United States Patent
Walsh et al.

(10) Patent No.: US 9,156,582 B2
(45) Date of Patent: Oct. 13, 2015

(54) CARTON WITH OPENING FEATURE

(71) Applicant: Graphic Packaging International, Inc., Atlanta, GA (US)

(72) Inventors: Joseph C. Walsh, Boulder, CO (US); Mark Sinclair, Arvada, CO (US); Jeffrey T. Sloat, Broomfield, CO (US); Norman L. Jesch, Golden, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 120 days.

(21) Appl. No.: 14/050,878

(22) Filed: Oct. 10, 2013

(65) Prior Publication Data

US 2014/0034717 A1 Feb. 6, 2014

Related U.S. Application Data

(63) Continuation of application No. PCT/US2012/035330, filed on Apr. 27, 2012.

(60) Provisional application No. 61/518,192, filed on May 2, 2011.

(51) Int. Cl.

| | |
|---|---|
| ***B65D 5/54*** | (2006.01) |
| ***B65D 5/56*** | (2006.01) |
| ***B65D 5/72*** | (2006.01) |

(Continued)

(52) U.S. Cl.

CPC ..... *B65D 5/5435* (2013.01); *B31B 1/25* (2013.01); *B31B 1/26* (2013.01); *B31B 1/90* (2013.01); *B31B 7/00* (2013.01); *B65D 5/02* (2013.01); *B65D 5/541* (2013.01); *B65D 5/56* (2013.01); *B65D 5/563* (2013.01); *B65D 5/603* (2013.01); *B65D 5/606* (2013.01); *B65D 5/701* (2013.01);

(Continued)

(58) Field of Classification Search

CPC ..... B65D 5/603; B65D 5/606; B65D 5/725; B65D 5/727; B65D 2517/0037

USPC ..... 229/117.3, 117.31

See application file for complete search history.

(56) References Cited

U.S. PATENT DOCUMENTS

| | | | |
|---|---|---|---|
| 1,772,625 | A | 8/1930 | Caulfield |
| 1,837,750 | A | 12/1931 | Becker |

(Continued)

FOREIGN PATENT DOCUMENTS

| | | |
|---|---|---|
| CH | 412 695 | 4/1966 |
| DE | 29 23 455 | 12/1980 |

(Continued)

OTHER PUBLICATIONS

Supplementary European Search Report for EP 12 77 9392 dated Nov. 3, 2014.

(Continued)

*Primary Examiner* — Gary Elkins

(74) *Attorney, Agent, or Firm* — Womble Carlyle Sandridge & Rice, LLP

(57) ABSTRACT

A package for holding a product. The package can comprise a carton comprising a plurality of panels at least partially enclosing an interior of the carton. A liner may optionally be at least partially positioned in the interior of the carton and can comprise an inner dispensing feature. A liner patch can overlap the inner dispensing feature and can be mounted on the liner for facilitating opening of the inner dispensing feature of the liner.

41 Claims, 8 Drawing Sheets

(51) Int. Cl.

| | |
|---|---|
| ***B31B 1/90*** | (2006.01) |
| ***B31B 7/00*** | (2006.01) |
| ***B65D 5/60*** | (2006.01) |
| ***B65D 5/70*** | (2006.01) |
| ***B65D 5/74*** | (2006.01) |
| ***B65D 5/02*** | (2006.01) |
| ***B31B 1/25*** | (2006.01) |
| ***B31B 1/26*** | (2006.01) |

(52) U.S. Cl.

CPC ..... *B65D 5/725* (2013.01); *B65D 5/727* (2013.01); *B65D 5/746* (2013.01)

(56) References Cited

U.S. PATENT DOCUMENTS

| | | | | |
|---|---|---|---|---|
| 1,842,237 | A | 1/1932 | Becker | |
| 1,920,653 | A | 8/1933 | McLaughlin | |
| 1,973,960 | A | 9/1934 | McLaughlin | |
| 2,010,863 | A | 8/1935 | Johnson | |
| 2,192,722 | A | 3/1940 | Vogt | |
| 2,355,665 | A | 8/1944 | Mabee | |
| 2,361,984 | A | 11/1944 | Williamson | |
| 2,475,677 | A | 7/1949 | Ringler | |
| 2,509,289 | A | 5/1950 | Dunning | |
| 2,593,778 | A | 4/1952 | McGinnis | |
| 2,634,897 | A | 4/1953 | Bord | |
| 2,683,953 | A | 7/1954 | Hopkins | |
| 2,701,678 | A | 1/1955 | Read | |
| 2,738,916 | A | 3/1956 | Peters | |
| 2,778,557 | A | 1/1957 | Moore | |
| 2,820,585 | A | 1/1958 | Nerenberg et al. | |
| 2,862,649 | A | 12/1958 | Bergstein | |
| 2,989,224 | A | 6/1961 | Umanoff | |
| 3,017,065 | A | 1/1962 | Collie | |
| 3,085,733 | A | 4/1963 | Umanoff | |
| 3,127,082 | A | 3/1964 | Meyer-Jagenberg | |
| 3,133,688 | A | 5/1964 | Asman | |
| 3,250,436 | A | 5/1966 | Kurtz | |
| 3,254,793 | A | 6/1966 | Palmer | |
| 3,347,446 | A | 10/1967 | Guyer et al. | |
| 3,355,089 | A | 11/1967 | Champlin | |
| 3,363,822 | A | 1/1968 | Maulini et al. | |
| 3,426,955 | A | 2/1969 | Olson | |
| 3,580,466 | A * | 5/1971 | Thelen et al. | 229/117.31 |
| 3,580,483 | A | 5/1971 | Young | |
| 3,587,944 | A | 6/1971 | Pehr | |
| 3,605,578 | A | 9/1971 | Sternau | |
| 3,669,345 | A | 6/1972 | Cote | |
| 3,680,766 | A | 8/1972 | Collura et al. | |
| 3,690,544 | A | 9/1972 | Meyers | |
| 3,764,058 | A | 10/1973 | Forbes, Jr. | |
| 3,768,719 | A | 10/1973 | Johnson | |
| 4,094,456 | A | 6/1978 | Raccaforte | |
| 4,138,016 | A | 2/1979 | Roccaforte | |
| 4,141,485 | A | 2/1979 | Lambert | |
| 4,150,778 | A | 4/1979 | Engdahl, Jr. | |
| 4,168,003 | A | 9/1979 | Wysocki | |
| 4,194,677 | A | 3/1980 | Wysocki | |
| 4,201,329 | A | 5/1980 | Roccaforte | |
| 4,344,537 | A | 8/1982 | Austin | |
| 4,361,270 | A | 11/1982 | Roccaforte | |
| 4,411,365 | A | 10/1983 | Horikawa et al. | |
| 4,484,683 | A | 11/1984 | Werner, Jr. | |
| 4,508,218 | A | 4/1985 | Focke et al. | |
| 4,558,785 | A | 12/1985 | Gordon | |
| 4,565,315 | A | 1/1986 | Wagner et al. | |
| 4,609,142 | A | 9/1986 | Adamek | |
| 4,645,108 | A | 2/1987 | Gavin et al. | |
| 4,676,394 | A | 6/1987 | Hiersteiner | |
| 4,782,788 | A | 11/1988 | Arcand | |
| 4,905,898 | A | 3/1990 | Wade | |
| 4,953,781 | A | 9/1990 | Bryan | |
| 5,014,888 | A | 5/1991 | Bryan | |
| 5,031,825 | A | 7/1991 | Romagnoli | |
| 5,056,708 | A | 10/1991 | Boyle et al. | |
| 5,078,273 | A | 1/1992 | Kuchenbecker | |
| 5,107,120 | A | 4/1992 | Tom | |
| 5,110,042 | A | 5/1992 | Hurden | |
| 5,141,150 | A | 8/1992 | Plaessmann | |
| 5,145,091 | A | 9/1992 | Meyers | |
| 5,147,272 | A | 9/1992 | Richison et al. | |
| 5,147,480 | A | 9/1992 | Lang | |
| 5,166,681 | A | 11/1992 | Bottesch et al. | |
| 5,215,250 | A | 6/1993 | Roccaforte | |
| 5,251,808 | A | 10/1993 | Rudd | |
| 5,259,552 | A | 11/1993 | Kuchenbecker | |
| 5,292,058 | A | 3/1994 | Zoss et al. | |
| 5,347,865 | A | 9/1994 | Mulry et al. | |
| 5,372,301 | A | 12/1994 | Besson | |
| 5,429,297 | A | 7/1995 | Walsh | |
| 5,445,316 | A | 8/1995 | Roccaforte | |
| 5,632,402 | A | 5/1997 | Walsh | |
| 5,660,324 | A | 8/1997 | Rowland | |
| 5,668,539 | A | 9/1997 | Patchell | |
| 5,678,755 | A | 10/1997 | Block | |
| 5,680,986 | A | 10/1997 | Botterman | |
| 5,746,871 | A | 5/1998 | Walsh | |
| 5,783,030 | A | 7/1998 | Walsh | |
| 5,794,811 | A | 8/1998 | Walsh | |
| 5,794,812 | A | 8/1998 | Walsh | |
| 5,857,614 | A | 1/1999 | Walsh | |
| 5,876,317 | A | 3/1999 | Sigrist et al. | |
| 5,918,799 | A | 7/1999 | Walsh | |
| 5,992,734 | A | 11/1999 | Tokarski et al. | |
| 5,996,797 | A | 12/1999 | Flaig | |
| 6,050,484 | A | 4/2000 | Galomb | |
| 6,059,182 | A | 5/2000 | Wein | |
| 6,062,467 | A | 5/2000 | Ours et al. | |
| 6,102,277 | A | 8/2000 | Krapohl, Sr. | |
| 6,109,517 | A | 8/2000 | Cabrera | |
| 6,120,184 | A | 9/2000 | Laurence et al. | |
| 6,145,736 | A | 11/2000 | Ours et al. | |
| 6,152,360 | A | 11/2000 | Block et al. | |
| 6,206,279 | B1 | 3/2001 | Countee | |
| 6,213,388 | B1 | 4/2001 | Ours et al. | |
| 6,227,440 | B1 | 5/2001 | Hart | |
| 6,328,472 | B1 | 12/2001 | Laurence et al. | |
| 6,336,584 | B1 | 1/2002 | Roch et al. | |
| 6,352,096 | B1 | 3/2002 | Walsh | |
| 6,386,438 | B1 | 5/2002 | Walsh et al. | |
| 6,419,151 | B1 | 7/2002 | Urtubey | |
| 6,424,272 | B1 | 7/2002 | Gutta et al. | |
| 6,474,040 | B1 * | 11/2002 | Ours et al. | 53/133.3 |
| 6,478,216 | B2 | 11/2002 | Wiart | |
| 6,634,546 | B2 * | 10/2003 | Heeley et al. | 229/222 |
| 6,676,009 | B1 | 1/2004 | Rose | |
| 6,753,766 | B2 | 6/2004 | Patchell | |
| 6,854,639 | B2 | 2/2005 | Walsh | |
| 6,889,892 | B2 | 5/2005 | Walsh et al. | |
| 6,961,006 | B2 | 11/2005 | Harter, Jr. et al. | |
| 7,025,504 | B2 | 4/2006 | Olin | |
| 7,036,714 | B2 | 5/2006 | Walsh et al. | |
| 7,148,482 | B2 | 12/2006 | Harter, Jr. | |
| 7,210,612 | B2 | 5/2007 | Walsh et al. | |
| 7,253,722 | B2 | 8/2007 | Deasy et al. | |
| 7,648,024 | B2 | 1/2010 | Mitten et al. | |
| 7,665,629 | B2 | 2/2010 | Julius et al. | |
| 7,938,312 | B2 | 5/2011 | Ford | |
| 7,984,844 | B2 | 7/2011 | Jones | |
| 8,066,137 | B2 | 11/2011 | Sanfilippo et al. | |
| 8,418,885 | B2 | 4/2013 | Kasai | |
| 2001/0048022 | A1 | 12/2001 | Zoeckler | |
| 2002/0055429 | A1 | 5/2002 | Walsh | |
| 2003/0057266 | A1 | 3/2003 | Sedo | |
| 2003/0136819 | A1 | 7/2003 | Walsh et al. | |
| 2003/0144121 | A1 | 7/2003 | Walsh et al. | |
| 2004/0226989 | A1 | 11/2004 | Cook et al. | |
| 2005/0127150 | A1 | 6/2005 | Walsh et al. | |
| 2005/0187087 | A1 | 8/2005 | Walsh | |
| 2005/0211903 | A1 | 9/2005 | Harter, Jr. | |
| 2005/0224564 | A1 | 10/2005 | Walsh | |
| 2005/0274086 | A1 | 12/2005 | Petrelli et al. | |
| 2005/0274782 | A1 | 12/2005 | Petrelli et al. | |

(56) References Cited

U.S. PATENT DOCUMENTS

| | | | | |
|---|---|---|---|---|
| 2006/0054675 | A1 | 3/2006 | Bennett | |
| 2006/0067378 | A1 | 3/2006 | Rege et al. | |
| 2006/0243783 | A1 | 11/2006 | Spivey, Sr. et al. | |
| 2006/0255106 | A1 | 11/2006 | Green | |
| 2006/0255109 | A1 | 11/2006 | Green | |
| 2006/0255113 | A1 | 11/2006 | McGowan | |
| 2007/0131752 | A1 | 6/2007 | Jones | |
| 2010/0019022 | A1 | 1/2010 | Ryan et al. | |
| 2010/0140129 | A1 | 6/2010 | Sanfilippo et al. | |
| 2011/0266298 | A1 | 11/2011 | Burgos Agudo | |
| 2013/0001284 | A1 * | 1/2013 | Hengami | 229/117.3 |

FOREIGN PATENT DOCUMENTS

| | | | | |
|---|---|---|---|---|
| DE | 81 10 323.9 | | 9/1981 | |
| DE | 33 07 758 | | 9/1984 | |
| DE | 87 08 078.8 | | 10/1987 | |
| DE | 43 08 047 | | 12/1993 | |
| DE | 93 20 241 5 | | 3/1994 | |
| DE | 94 13 813 | | 10/1994 | |
| DE | 10 2008 035 467 | A1 | 2/2010 | |
| EP | 126440 | A2 * | 11/1984 | B31B 7/00 |
| EP | 0 466 337 | | 1/1992 | |
| EP | 0 529 260 | | 3/1993 | |
| EP | 0 530 643 | | 3/1993 | |
| EP | 1 457 425 | | 9/2004 | |
| EP | 1 562 053 | | 8/2005 | |
| EP | 1 580 542 | | 9/2005 | |
| FR | 2 699 150 | | 6/1994 | |
| FR | 2 755 670 | | 5/1998 | |
| GB | 104445 | | 3/1917 | |
| GB | 385033 | | 12/1932 | |
| GB | 393199 | | 6/1933 | |
| GB | 1 242 356 | | 8/1971 | |
| GB | 1 489 963 | | 10/1977 | |
| GB | 1 584 066 | | 2/1981 | |
| GB | 2 363 372 | | 12/2001 | |
| WO | WO 95/28325 | | 10/1995 | |
| WO | WO 99/38779 | | 8/1999 | |
| WO | WO 00/74931 | | 12/2000 | |
| WO | WO 02/04302 | | 1/2002 | |
| WO | WO 2005/082738 | A1 | 9/2005 | |
| WO | WO 2006/124643 | | 11/2006 | |
| WO | WO 2006/133401 | | 12/2006 | |
| WO | WO 2008/086272 | | 7/2008 | |
| WO | WO 2009/018400 | | 2/2009 | |

OTHER PUBLICATIONS

International Search Report and Written Opinion for PCT/US2012/035330 dated Oct. 31, 2012.

* cited by examiner

CARTON WITH OPENING FEATURE

CROSS-REFERENCE TO RELATED APPLICATIONS

This application is a continuation application of PCT/US2012/035330, filed Apr. 27, 2012, which application claims the benefit of U.S. Provisional Patent Application No. 61/518,192, filed May 2, 2011.

INCORPORATION BY REFERENCE

The disclosures of International Application No. PCT/US2012/035330, which was filed on Apr. 27, 2012, U.S. Provisional Patent Application No. 61/518,192, which was filed on May 2, 2011, and International Application No. PCT/US2012/022458, which was filed on Jan. 25, 2012, are hereby incorporated by reference for all purposes as if presented herein in their entirety.

BACKGROUND OF THE DISCLOSURE

The present disclosure generally relates to packages or cartons for holding and dispensing products, such as food products. More specifically, the present disclosure relates to lined cartons with dispensing features.

SUMMARY OF THE DISCLOSURE

In general, one aspect of the disclosure is generally directed to a package for holding a product. The package can comprise a carton comprising a plurality of panels at least partially enclosing an interior of the carton. A liner may optionally be at least partially positioned in the interior of the carton and can comprise an inner dispensing feature. A liner patch can overlap the inner dispensing feature and can be mounted on the liner for facilitating opening of the inner dispensing feature of the liner.

In another aspect, the disclosure is generally directed to a combination of a carton blank, a liner, and a liner patch for forming a package. The carton blank can comprise a plurality of panels respectively foldably connected to one another. The liner can be mounted on at least one panel of the plurality of panels and can comprise an inner dispensing feature. The liner patch can overlap the inner dispensing feature and can be mounted on the liner for facilitating opening of the inner dispensing feature.

In another aspect, the disclosure is generally directed to a method of forming a package. The method can comprise forming a package comprising a liner, a liner patch mounted on the liner, and a carton comprising a plurality of panels. The forming of the package can comprise forming an inner dispensing feature in the liner. The liner patch can overlap the inner dispensing feature. The forming of the package can further comprise forming an interior of the carton at least partially defined by the plurality of panels. The liner can be at least partially positioned in the interior of the carton.

In another aspect, the disclosure is generally directed to a method of opening a package. The method can comprise obtaining a package comprising a carton comprising a plurality of panels at least partially enclosing an interior of the carton, a liner at least partially positioned in the interior of the carton, the liner comprising an inner dispensing feature, and a liner patch mounted on the liner and overlapping the inner dispensing feature. The method further can comprise forming an inner dispenser opening in the inner dispensing feature of the liner by at least partially removing the liner patch from the liner.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale and may be schematic. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles at least partially disposed within the carton embodiments. In one embodiment, the articles held in the carton can be food products, but the articles could be other nonfood products without departing from the disclosure. In this specification, the terms "lower," "bottom," "upper," "top," "front," and "back" indicate orientations determined in relation to fully erected cartons.

Figure 1:
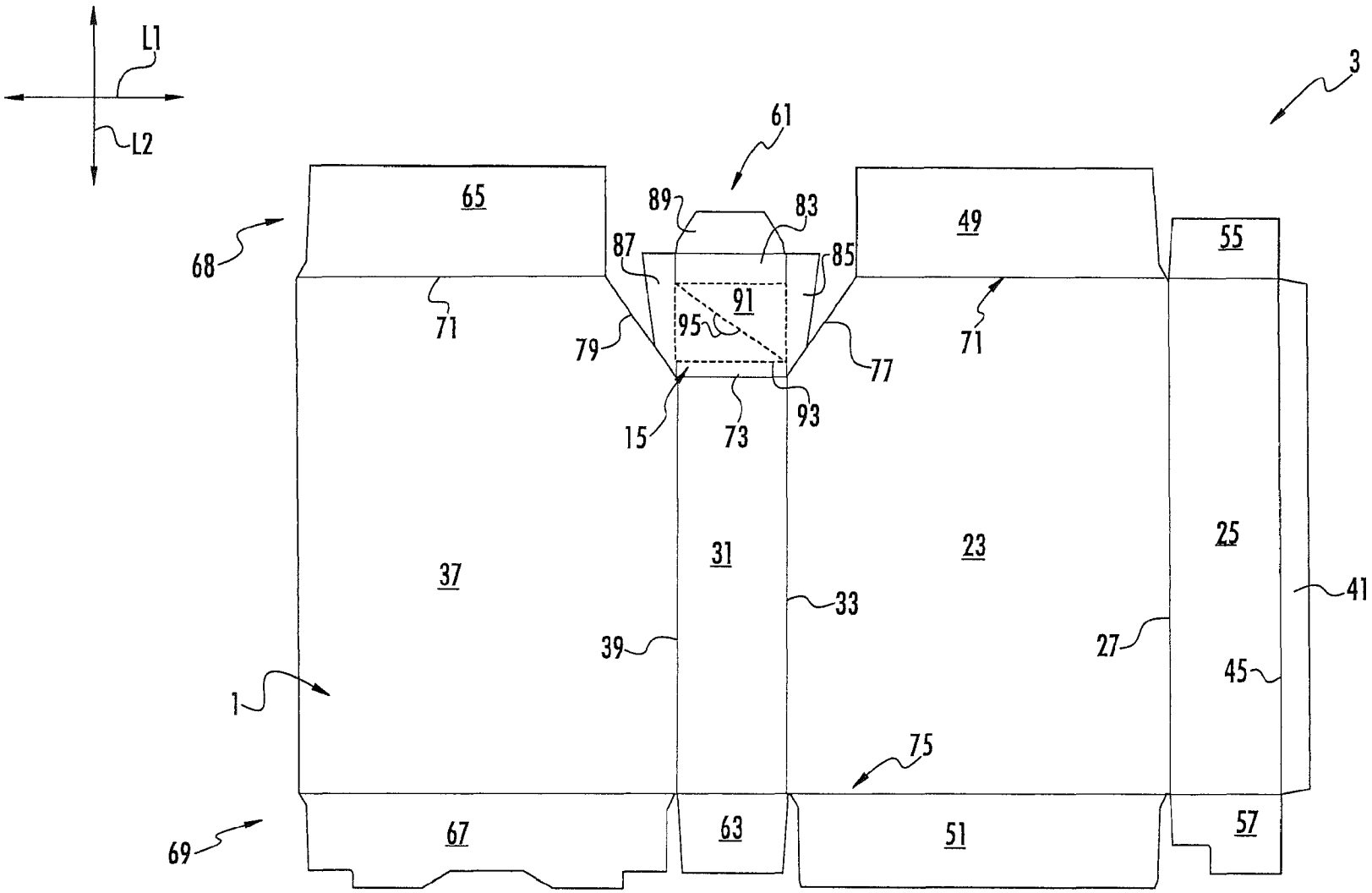
FIG. 1 is an exterior plan view of a blank used to form a carton in accordance with an exemplary embodiment of the disclosure.
Figure 2:
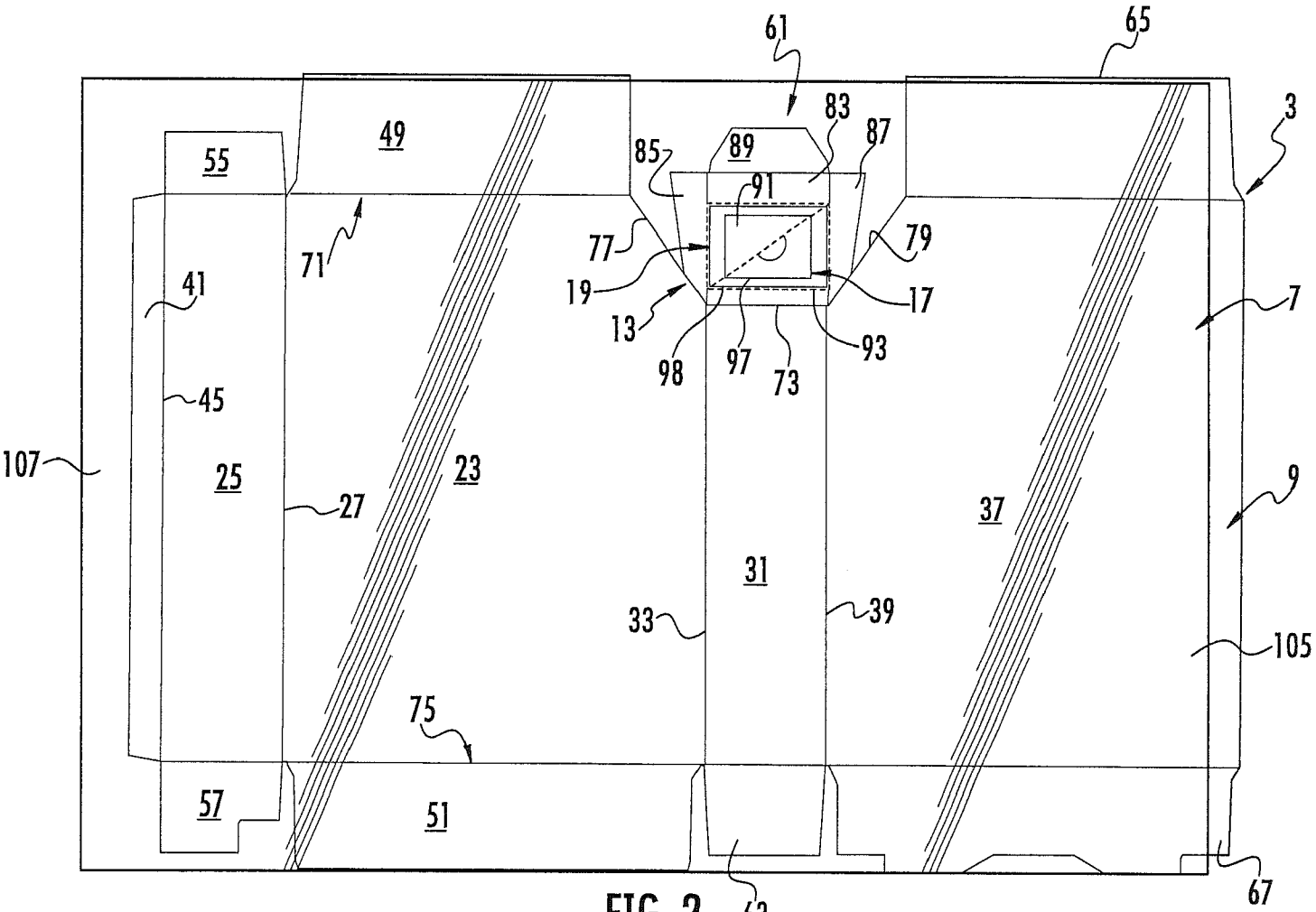
FIG. 2 is an interior plan view of the blank of FIG. 1 with a liner mounted on the interior surface of the blank.
Figure 3:
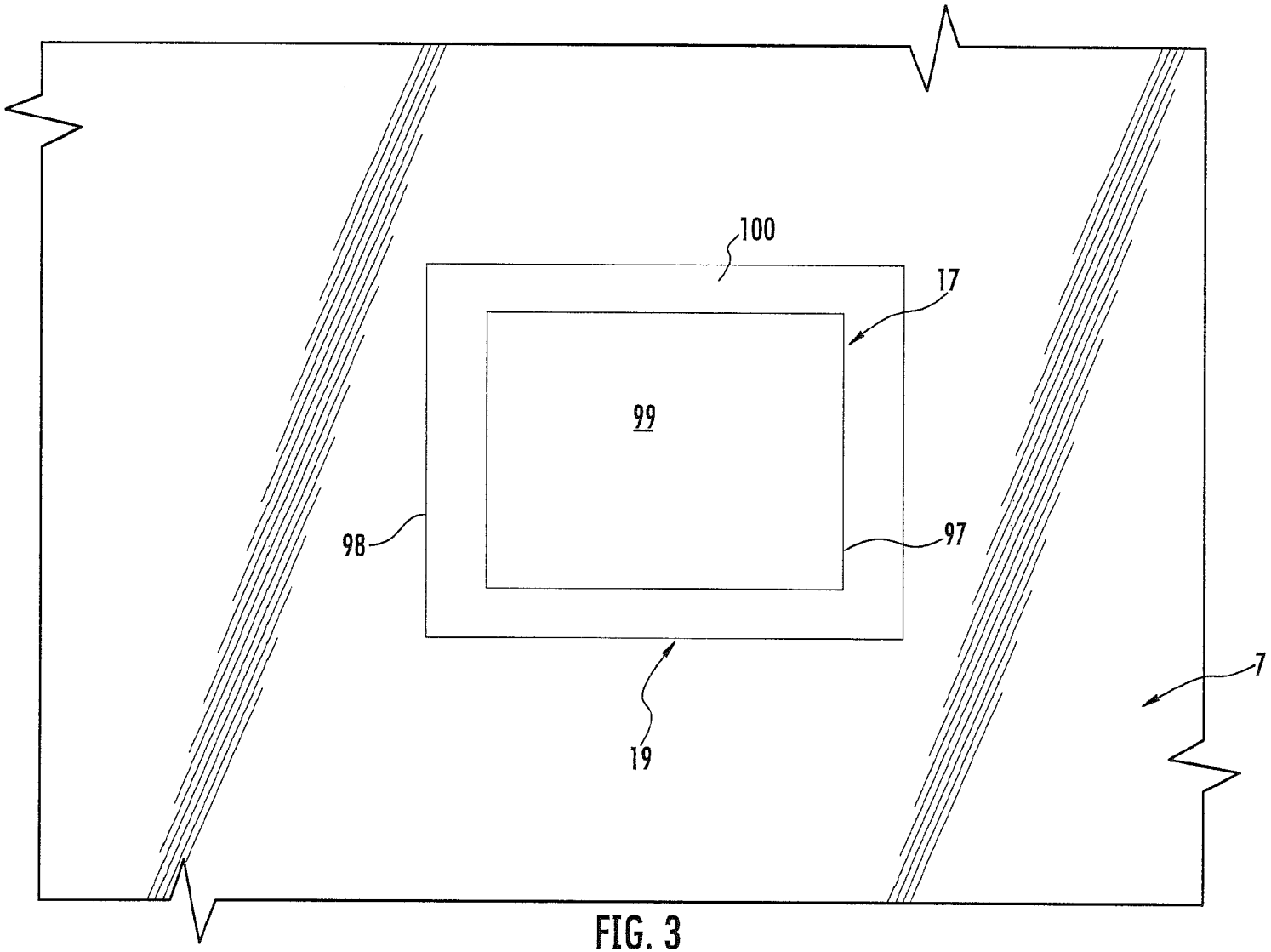
FIG. 3 is a detail view of a dispensing feature of the liner of FIG. 3 and a liner patch according to the exemplary embodiment of the disclosure.

FIG. 1 is a plan view of an exterior surface 1 of a carton blank 3 used to form an outer carton 4 of a package 5 (FIGS. 5 and 6) of a first embodiment of the disclosure. The package 5 includes a liner 7 that is in contact with an interior surface 9 of the blank 3 (FIG. 2). The liner 7 is shown as transparent in the figures for clarity; however, the liner can have any level of transparency or translucency, or the liner can be opaque. The package 5 can be configured to hold articles (not shown) such as a plurality of food products (e.g., candy, crackers, popcorn, breakfast cereal, or any other food product) or nonfood products (grass seed, fertilizer, detergent, or any other nonfood product), or any other suitable article or product within an interior 11 (FIG. 7) of the package. The liner 7 can help maintain freshness and quality of the products by enhancing the barrier protection provided by the carton 4. In one embodiment, the liner 7 can be hermetically sealed, or nearly hermetically sealed, around the interior 11. The package 5 can include a dispenser 13 (FIGS. 5-7), including an outer dispensing feature 15 extending in the blank 3, an inner dispensing feature 17 extending in the liner 7 (FIG. 3), and a liner patch 19 (FIG. 3). The package 5 can include various dispensing features and various handle features without departing from the disclosure.

The blank 3 has a longitudinal axis L1 extending generally in the direction of the length of the blank and a lateral axis L2 extending generally in the direction of the width of the blank. The blank 3 includes a front panel 23 foldably connected to a first side panel 25 at a lateral fold line 27. A second side panel 31 is foldably connected to the front panel 23 at a lateral fold line 33. A back panel 37 is foldably connected to second side panel 31 at a lateral fold line 39. An attachment flap 41 is foldably connected to the first side panel 25 at a lateral fold line 45. Alternatively, the attachment flap 41 could be foldably connected to the back panel 37 (not shown).

In the illustrated embodiment, the front panel 23 includes two end flaps 49, 51 foldably connected to opposite ends of the front panel. The first side panel 25 has two end flaps 55, 57 foldably connected to opposite ends of the first side panel. The second side panel 31 has an end flap or mount assembly 61 and an end flap 63 foldably connected to opposite ends of the second side panel. The back panel 37 has two end flaps 65, 67 foldably connected to opposite ends of the back panel. When the carton 4 is erected, the end flaps 49, 55, 61, 65 close a first (e.g., top) end 68 of the carton, and the end flaps 51, 57, 63, 67 close a second (e.g., bottom) end 69 of the carton. In accordance with an alternative embodiment of the present disclosure, different panel and flap arrangements can be used for closing the carton 4.

The end flaps 49, 55, 65 of the first end 68 extend along a first marginal area of the blank 3, and are foldably connected at a first longitudinal fold line 71 that extends along the length of the blank. The end flaps 51, 57, 63, 67 of the second end 69 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 65, 51, 57, 63, 67 can be alternatively shaped, arranged, positioned, and/or omitted without departing from the disclosure.

As shown in FIG. 1, the mount assembly 61 is foldably connected to the second side panel 31 along a longitudinal fold line 73. The front panel 23 has an oblique edge 77 extending between the fold lines 71, 73, and the back panel 37 has an oblique edge 79 extending between the fold lines 71, 73. When the blank 3 is erected into the carton 4 (FIGS. 5 and 6), the mount assembly 61 forms an obliquely configured, upper corner of the carton to which a reclosable fitment 81 (FIGS. 6 and 7) can be mounted, such as by an adhesive. The mount assembly 61 has a central panel 83 and mounting flaps 85, 87, 89 that are respectively foldably connected to the central panel 83. The outer dispensing feature 15 of the dispenser 13 can include a dispenser panel 91 defined by a tear line 93 extending in at least the central panel 83. The dispenser panel 91 can include an access opening or flap 95 for helping to initiate tearing of the tear line 93. The access flap 95 can be, for example, disposed along an oblique fold line or tear line in the dispenser panel 91. The dispenser panel 91 can be alternatively shaped, arranged, positioned, and/or omitted without departing from the disclosure. For example, the access flap 95 could be disposed adjacent the tear line 93, such as at a corner of the dispenser panel 91.

As shown in FIG. 2, the liner 7 overlays the interior surface 9 of the blank 3. The liner 7 can comprise one or more layers (not shown) and can be composed of any suitable material that is relatively flexible and relatively fluid impervious. For example, a polymer layer can be laminated to, or otherwise fixedly attached to, a paper layer. The polymer layer can comprise polyethylene, polypropylene, polyethylene terephthalate, polystyrene, polyvinyl chloride, or any other suitable material. In addition, the liner 7 can include additional layers, such as a foil layer, multiple paper layers, and multiple polymer layers, or a single layer, such as a single polymer layer. For example, an optional metallization layer can be deposited on the inner or outer surface of the liner 7 to further increase the barrier properties of the liner 7. The metallization layer may be provided on a surface of the liner 7 by vapor deposition and can be an aluminum layer, for example. In use, a liner can have any suitable number of paper, foil, and/or polymer layers in any suitable combination (e.g., one polymer layer, a foil layer between two polymer layers, or a polymer layer on a foil layer on a second polymer layer on a paper layer, etc). In an alternative embodiment, the liner 7 could comprise a fluid pervious material without departing from the scope of the disclosure.

Referring to FIG. 3, the inner dispensing feature 17 of the dispenser 13 can include a cut line 97 extending in the liner 7 and defining an inner dispenser panel 99 that can be aligned with the outer dispensing feature 15. The cut line 97 can be a generally continuous cut in the liner 7 extending through the entire thickness of the liner substantially along the entire length of the cut line 97. The cut line 97 can have some polymer bridging, nicks, and/or other formations weakly connecting the inner dispenser panel 99 to the remainder of the liner 7 as a consequence of imperfections in the cutting process or by design. Alternatively, the cut line 97 can be a clean cut, and the inner dispenser panel 99 can be completely separated from the liner 7, for example. The cut line 97 can be formed in the liner 7 by a software-driven laser cutting system or other laser system, a rule die cutting tool or other mechanical cutting system, heat stamping, or any other suitable method. The inner dispensing feature 13 can be alternatively formed in the liner 7 without departing from the disclosure.

The cut line 97 is schematically shown in FIGS. 2-4B and alternatively can be substantially any separating line (e.g., tear line, cut line, perforated line, combinations thereof, etc.) or other line of weakening. For example, the separating line 97 could be a tear line formed in the liner 7 by removing at least a portion of one or more layers of the liner to form kiss cut(s) and/or a series of perforations (e.g., micro-perforations). For example, a software-driven laser cutting system can be used to remove one or all layers of the liner in a series of holes (e.g., cuts, kiss cuts, shallow slits, or the like). Alternatively, the tear line can be formed mechanically, such as with a rule die cutting tool, heat stamping, or other suitable method. In the illustrated embodiment, the perforations can extend entirely through the liner 7 so that, for example, the liner can tear easily along the tear line to remove the inner dispenser panel 99. Alternatively, the tear line can be formed of kiss cuts that generally do not extend through the entire thickness of the liner 7, so that the tear line does not (e.g., substantially does not) define open passageways that extend through the entire thickness of the liner 7. For example, the liner 7 can include multiple layers of material (e.g., at least one paper layer and at least one polymer layer) and the perforations can be generally in one layer and not another.

Figure 7:
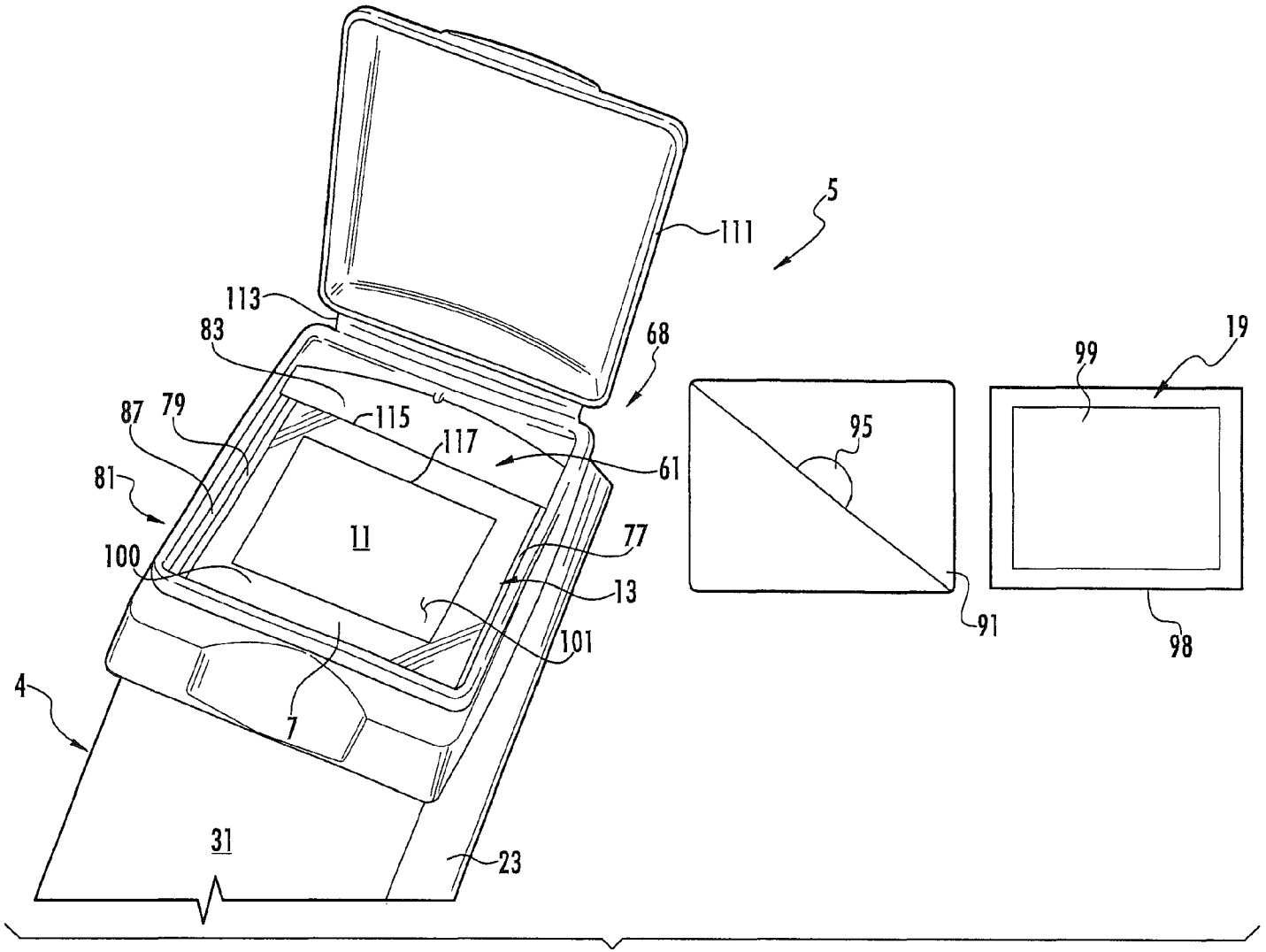
FIG. 7 is a perspective view of the carton and fitment of FIG. 6 with an opened dispenser in accordance with the exemplary embodiment of the disclosure.

As shown in FIG. 3, the liner patch 19 can be adhered or otherwise affixed or secured to the liner 7 over the cut line 97 and the inner dispenser panel 99 so that the adhesive securing the liner patch 19 to the liner forms a seal over and/or around the cut line 97 and/or the perforations, cuts, slits, etc. of substantially any separating line. Accordingly, the liner patch 19 can prevent fluid communication through the liner 7 at the cut line 97. In one embodiment, the portion of the liner 7 that extends between the cut line 97 and the outer edge 98 of the liner patch 19 (e.g., the portion of the liner 7 that is outside the inner dispenser panel 99 and is overlapped by the liner patch 19) is a sealing portion 100. This allows for easy removal of the inner dispenser panel 99 from the remainder of the liner (e.g., the cut line 97 extends entirely through the liner 7) without substantially compromising the barrier formed by the liner at the dispenser 13. The liner patch 19 can comprise the same or a similar material as the liner 7, or the liner patch can comprise any suitable material for helping to form a barrier at the inner dispensing feature 17. The liner patch 19 can be adhered, or otherwise attached, to the inner dispenser panel 99 so that removal of the liner patch 19 will remove the inner dispenser panel 99 (FIG. 7). For example, the liner patch 19 can be secured to the liner 7 by applying an adhesive to the liner and/or the liner patch, where the adhesive can be applied in a regular or irregular pattern so that at least a portion of the liner patch 19 is secured to the inner dispenser panel 99 and at least a portion of the liner patch 19 outside the cut line 97 forms a seal around the inner dispensing feature 17. The liner patch 19 can be otherwise secured to the liner 7, such as by heat welding, ultrasonic welding, or any other suitable method, without departing from the scope of the disclosure.

In one exemplary embodiment, the cut line 97 can be replaced with a tear line, for example, and the liner patch 19 can be adhered to the liner 7 similarly as described above in relation to the cut line 97 so that the liner patch 19 covers the perforations of the tear line and the adhesive securing the liner patch 19 to the liner forms a seal over and/or around the perforations of the tear line. Accordingly, the liner patch 19 can prevent fluid communication through any passageways extending through the liner 7 at the cuts or perforations forming the tear line. This allows the tear line to be configured to be easy to tear (e.g. perforations that extend entirely through the liner 7) for easy removal of the inner dispenser panel 99 from the remainder of the liner without substantially compromising the barrier formed by the liner at the dispenser 13. In one embodiment, the liner patch 19 can be secured to the liner 7 by an adhesive that is configured to allow the liner patch 19 to be readily pealed away from the liner 7, but that is sufficiently strong so that the inner dispenser panel 99 remains attached to the liner patch 19 and tears away from the remainder of the liner along the tear line. Alternatively, the liner patch 19 can be more securely attached to the inner dispenser panel 99 (e.g., with a stronger adhesive, heat welding, etc.) than the adhesive (e.g., pressure sensitive adhesive) connecting the outer portions of the liner patch 19 to the liner 7 over and outside the tear line. Accordingly, a user can relatively easily peal the liner patch 19 away from the liner 7 against the weaker adhesive when opening the dispenser 13, and the inner dispenser panel 99 will remain attached to the liner patch 19, tearing away from the remainder of the liner 7 along the tear line. Alternatively, the liner patch 19 can be otherwise secured to the liner 7.

In a particular embodiment, the liner patch 19 can be secured to the liner 7 by a pressure-sensitive adhesive or any other suitable adhesive for allowing the liner patch 19 to be readily pealed away from the liner 7 outside the cut line 97 and to be at least partially resealed over the opening 101 (FIG. 7) formed in the liner 7 by the inner dispenser panel 99. The liner patch 19 can be optionally more permanently secured (e.g., stronger adhesive, heat welded, ultrasonic welded, etc.) along one or more edges so that liner patch 19 can peal away from the liner 7 up to the more permanently secured edge (not shown). Accordingly, the more permanently secured edge acts as a hinge for the liner patch 19 so that the liner patch remains in position for being resealed over the dispenser opening 101. Alternatively, or in addition, a portion of the liner patch 19 (e.g., a corner or a tab) can be free from adhesive so that a user can readily grasp the un-adhered portion (not shown) for initiating removal of the liner patch.

In the present embodiment, the liner patch 19 can be secured to the liner 7 before or after formation of the cut line 97. For example, the cut line 97 can be formed in the liner 7 by cutting through the liner 7 with a laser, a rule die cutting tool, or another suitable cutting tool, and the liner patch 19 subsequently can be secured to the inner dispenser panel 99 and the liner 7 over and/or around the cut line 97 to preserve the barrier properties of the liner at the dispenser 13. Accordingly, the cut line 97 can be formed in the liner without consideration for the depth of the cut into the liner 7. In contrast, such consideration could be required if the liner patch 19 is omitted, wherein the barrier properties of the liner 7 might be preserved by cutting into the liner 7 without cutting through the liner 7. Alternatively, the liner patch 19 can be secured to the region of the liner 7 where the inner dispensing feature 17 will be formed, and the cut line 97 subsequently is cut into the liner 7. The cutting tool is set to cut through the liner 7, but not to cut entirely through the liner patch 19. Since the cutting tool can cut through the liner 7 and into the liner patch 19 without compromising the barrier properties at the dispenser 13, the thicker material (i.e., the liner 7 plus the liner patch 19 at the cut line 97) is relatively accommodating to variations in the depth of a cut, such as by a mechanical cutting tool. In addition, the liner patch 19, which is small compared to the liner 7 in the illustrated embodiment, can be formed of a "laser-friendly" material, so that a software-driven laser cutting system can be readily configured to cut through the liner 7 at the cut line 97, but not cut entirely through the liner patch 19. For example, the liner patch 19 can include a foil layer, which can serve as a laser stop layer so that the laser can be readily tuned to cut through the liner 7 only to the laser stop layer in the liner patch 19. In one embodiment, the laser stop layer can comprise metals, inks, dyes, and/or other materials. In one example, the laser stop layer can be in direct contact with the liner 7, or one or more layers of material (e.g., polymers, paper, etc.) of the liner patch 19 can be disposed between the liner 7 and the laser stop layer. Additionally, the liner patch 19 can include one or more outer layers on the laser stop layer, such as for printing. Accordingly, the liner 7 can comprise a simpler or less expensive material while only the liner patch 19 comprises the laser-friendly material or other relatively complex material.

In a particular embodiment where the liner patch 19 is generally opaque, the inner dispensing feature 17 can be readily inspected for breaches with an automated light-based inspection system. For example, the liner patch 19 can include a foil layer, a dyed layer, and/or a printed layer that blocks light passage, and a light sensor and a light source can be placed on opposite sides of the liner 7 and liner patch 19 to determine whether any openings have been formed in the liner patch 19, wherein this determining may be carried out at high speeds during processing of the blank 3 and liner 7. Alternatively, the laser stop layer and/or other layers of the liner patch 19 can be alternatively shaped, arranged, positioned, and/or omitted without departing from the disclosure.

Figure 4:
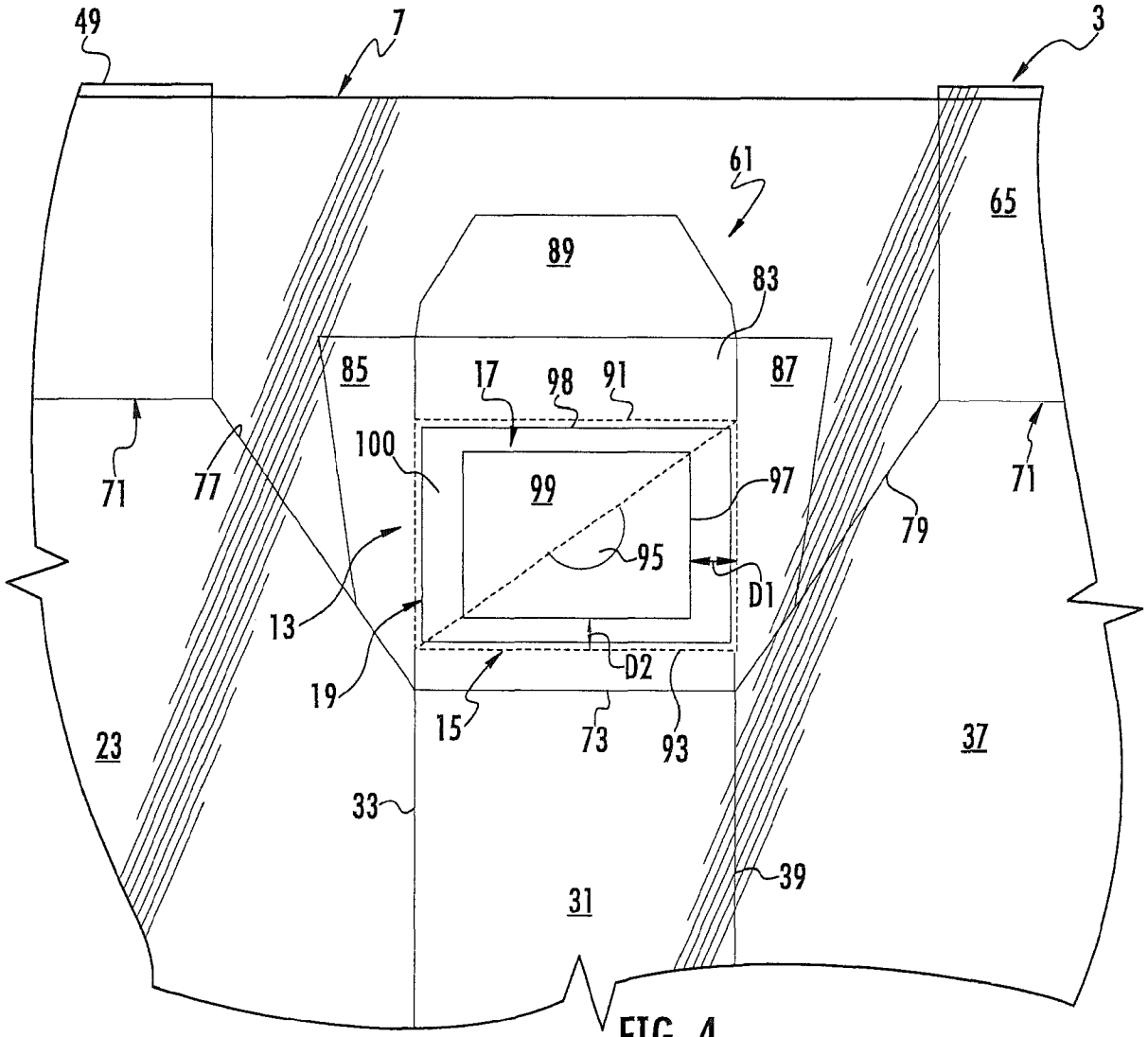
FIG. 4 is a detail view of the dispensing features of the liner and blank and the liner patch according to the exemplary embodiment of the disclosure.

As shown in FIGS. 3 and 4, the cut line 97 (or tear line or other separating line) and the liner patch 19 are generally rectangular for aligning with the outer dispensing feature 15 in the blank 3. The inner dispensing feature 17 and/or the liner patch 19 can be otherwise shaped, arranged, and/or configured without departing from the disclosure. For example, the cut line 97 and the liner patch 19 can be round, hexagonal, irregularly shaped, or any other suitable shape. Also, the liner patch 19 and the cut line 97 could be different shapes. Additionally, the inner dispenser 17 and the liner patch 19 can be configured to cooperate with any suitable outer dispenser in any suitable blank or outer carton without departing from the scope of the disclosure.

As shown in FIG. 4, when the liner 7 is attached to the interior surface 9 of the blank 3, the liner patch 19 and the inner dispensing feature 17 can be aligned with the outer dispensing feature 15. In the illustrated embodiment, the liner patch 19 is mounted on the exterior surface of the liner 7 so that the liner patch is sandwiched between the liner 7 and the mount assembly 61 of the blank 3. For example, the liner patch 19 can be in face-to-face contact with the liner 7 and at least the outer dispenser panel 91. The cut line 97 can be offset from the tear line 93 of the outer dispensing feature 15 by distances D1, D2, which can be generally equal distances or unequal distances. Accordingly, the inner dispensing feature 17 can accommodate higher tolerances for the alignment of the liner 7 with the blank 3 than when the cut line 97 is adjacent or overlaying the tear line 93 without the inner dispenser panel 99 being misaligned with the outer dispenser panel 91. Additionally, positioning cut lines or tear lines in the liner 7 over or adjacent to fold lines in the blank 3 can result in undesired separation of portions of the liner or other damage at the cut or tear line during processing of the blank and liner (e.g., during erection of the blank and liner into the package 5). Accordingly, the distances D1, D2 can help avoid opening of the inner dispensing feature 17 during formation of the package 5.

Figure 4A:
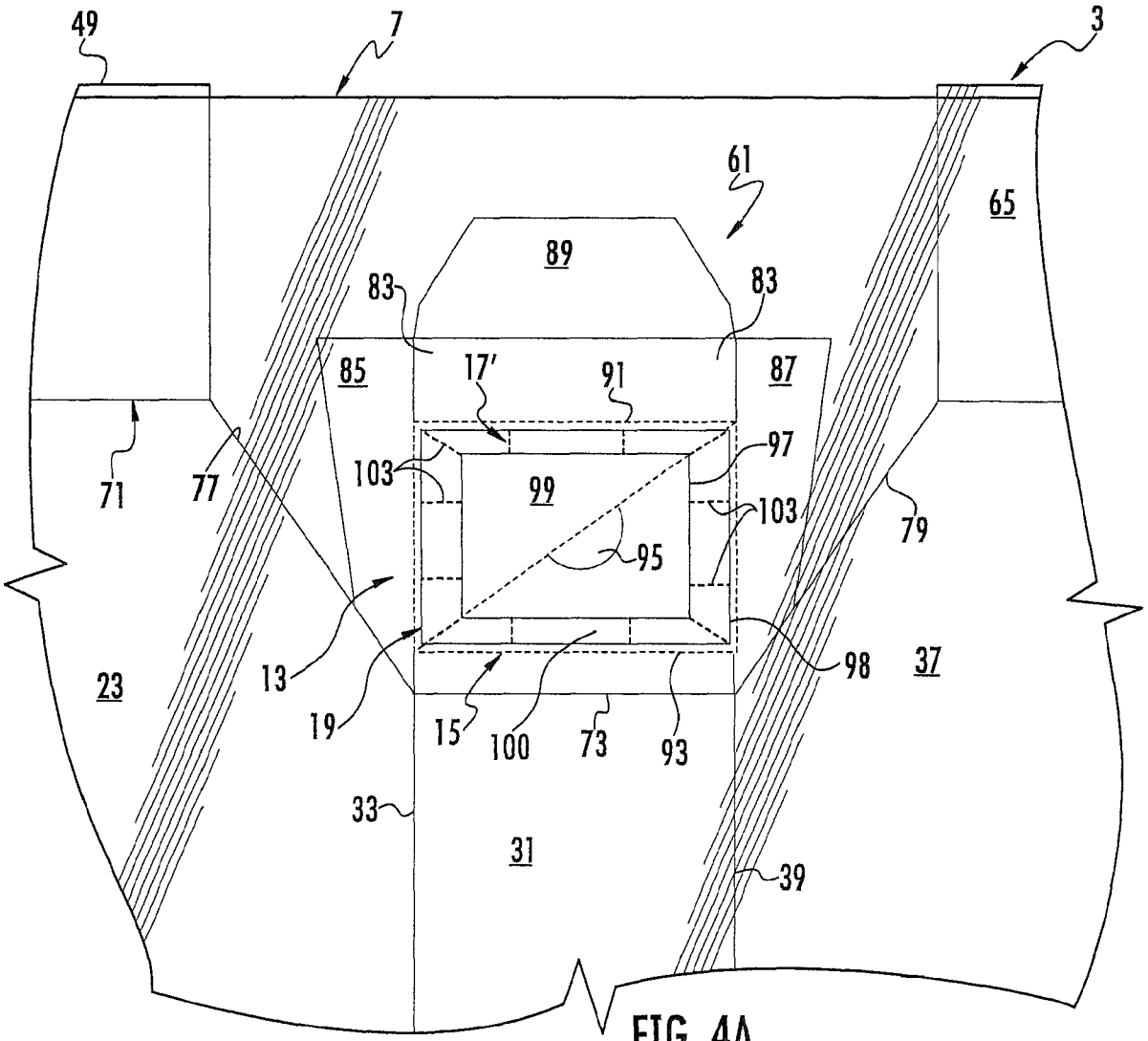
FIG. 4A is a detail view of the dispensing features with alternative dispensing features in the liner.

As shown in FIG. 4A, one or more optional radial cut or tear lines 103 (e.g., expansion lines) in the liner 7 adjacent to or extending from the cut line 97 can be included for facilitating widening of the opening 101 (FIG. 7) in the dispenser 13 after the liner patch 19 and the inner dispenser panel 99 are removed. A flowable product (e.g., breakfast cereal) can be subject to bridging when pouring the product through the opening 101. When bridging, some of the product can become lodged in the opening and prevent efficient dispensing of the product. Accordingly, it can be desirable to widen the opening 101 as much as possible to reduce bridging of the product in the opening. The radial cut or tear lines 103 allow the cut line 97 to be spaced apart from any fold lines in the blank 3 while avoiding bridging issues by allowing the opening 101 to widen after the liner patch 19 is removed. Once the liner patch 19 and the inner dispenser panel 99 are removed, the remaining liner 7 adjacent the opening 101 can be readily moved away from the opening 101 by separating along the radial cut or fold lines 103 and folding away from the opening, allowing easier passage of articles within the package 5 through the dispenser 13. In one embodiment, the radial cut or tear lines 103 can extend in the sealing portion 100 of the liner 7 and can be completely covered and sealed by the liner patch 19 before the dispenser 13 is opened, as shown in FIG. 4A. In an alternative embodiment, the cut line 97 can be adjacent to or at least partially overlay one or more fold lines in the blank 3. The dispenser feature 13 can be alternatively shaped, arranged, positioned, and/or omitted without departing from the disclosure.

Figure 5:
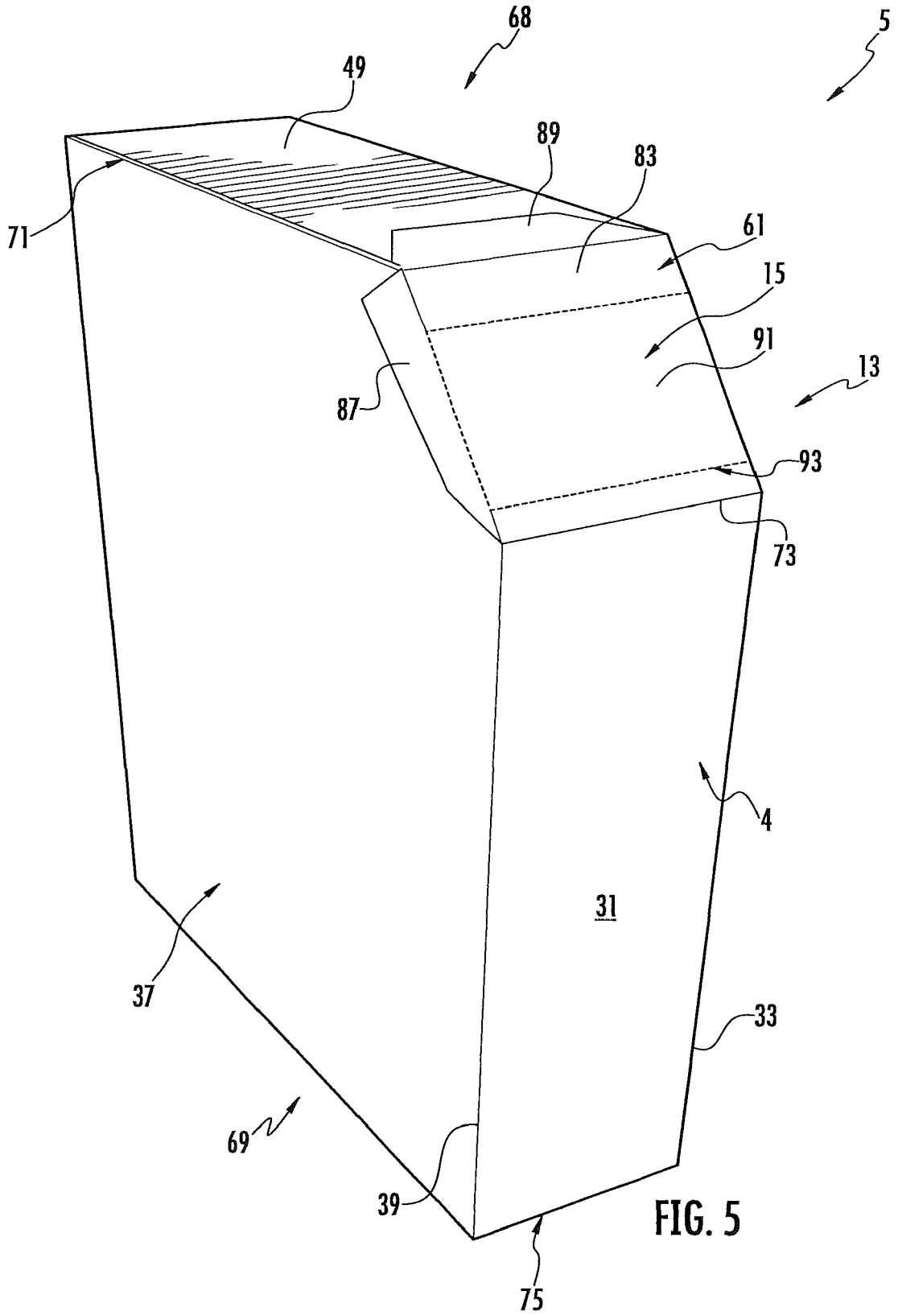
FIG. 5 is a perspective view showing the assembled carton in accordance with the exemplary embodiment of the disclosure.
Figure 6:
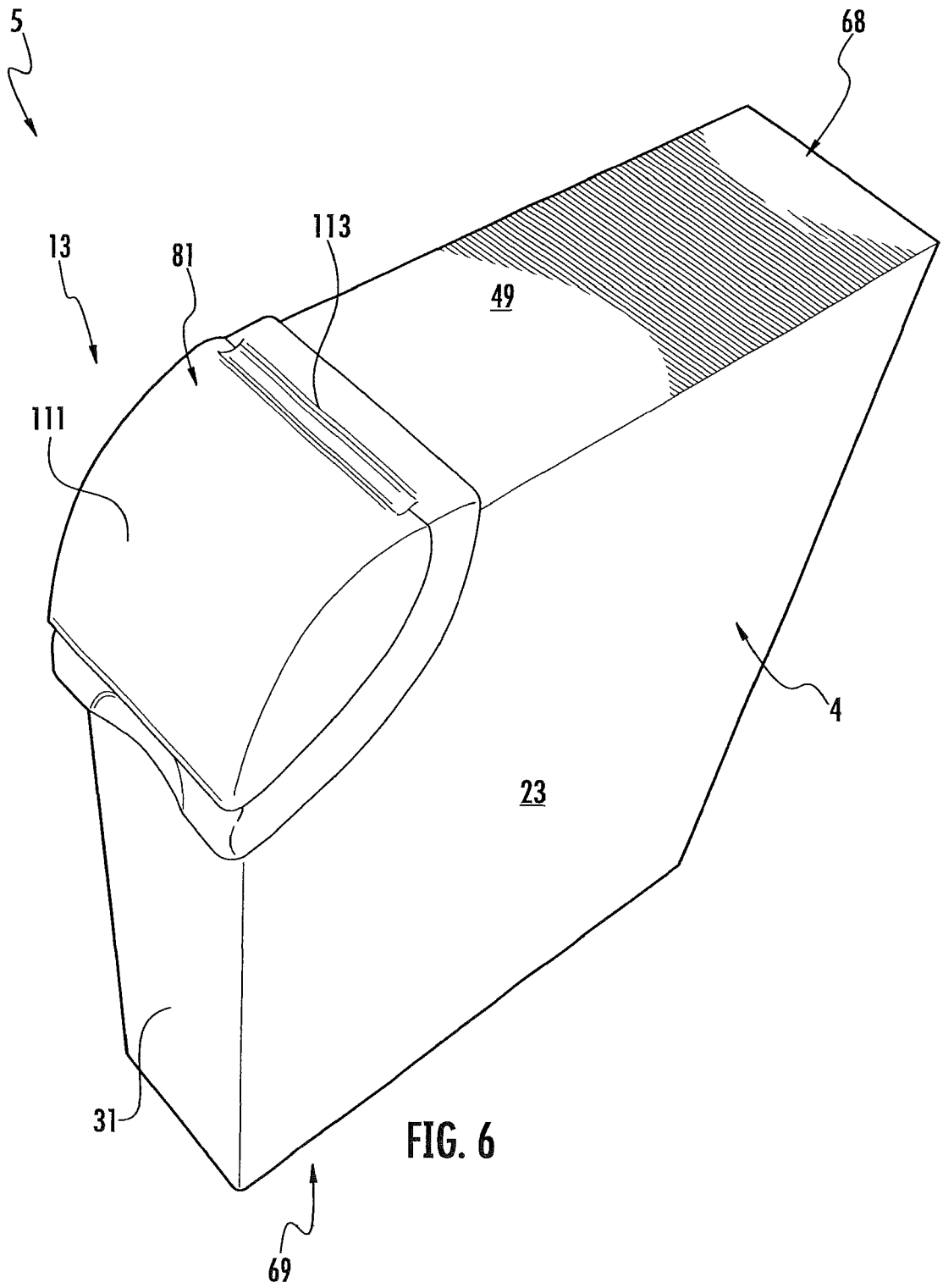
FIG. 6 is a perspective view of the carton of FIG. 5 with a fitment feature in accordance with the exemplary embodiment of the disclosure.

As shown in FIGS. 2, 5, and 6, and described in the following in accordance with one acceptable example, the package 5 is formed from the blank 3 by first overlaying the interior surface 9 of the blank with the liner 7. The liner 7 can be selectively attached to the blank 3 by adhesive, such as glue, or other attachment methods such as heat sealing, ultrasonic welding, etc. In the illustrated embodiment, the liner is glued to the front and back panels 23, 37, the side panels 25, 31, and at least a portion of the mount assembly 61. For example, the liner patch 19 can be glued to the outer dispenser panel 91 of the outer carton 4 so that the outer dispenser panel 91, the liner patch 19, and the inner dispenser panel 99 of the liner 7 are removed in a single step (e.g., for ease of use). Alternatively, the liner patch 19 can be free from connection to the outer dispenser panel 91 so that the liner patch 19 and the inner dispenser panel 99 can be removed subsequently to the outer dispenser panel 91 (e.g., for a tamper-evident opening). The portions of the liner 7 overlapping the lateral fold lines 27, 33, 39, 45, the longitudinal fold lines 71, 75, and the end flaps 49, 55, 65, 51, 57, 63, 67 are not glued to the blank 3 in an exemplary embodiment. In a particular embodiment, the portions of the panels 23, 25, 31, 37 immediately adjacent to the lateral fold lines 27, 33, 39, 45 and the longitudinal fold lines 71, 75 also can be free from glue to allow easier folding of the blank 3 along the fold lines. Alternatively, any suitable amount of the liner 7 can be glued to the blank 3 to secure the liner to the blank without departing from the disclosure. For example, discrete strips or dots of glue can be used to secure the liner 7 to the blank 3, or substantially all of the liner 7 overlapping the blank 3 can be glued to the blank so that the liner is glued to the front, back, and side panels 23, 37, 25, 31, the end flaps 49, 55, 61, 65, 51, 57, 63, 67, and the fold lines 27, 33, 39, 45, 71, 75. The liner 7 can be alternatively attached, or not attached, to the blank 3 without departing from the disclosure.

As shown in FIG. 2, the liner 7 can include a first lateral margin 105 and a second lateral margin 107, wherein the liner can overlap the blank 3 so that a portion of the back panel 37 and the end flaps 65, 67 adjacent the first lateral margin 105 are not overlapped by the liner prior to forming the package. Additionally, a portion of the liner 7 including the second lateral margin 107 can extend beyond the laterally-extending edge of the attachment flap 41. The blank 3 and the liner 7 can be folded along the lateral fold lines 33, 45 so that the lateral margins 105, 107 overlap one another and the back panel 37 overlaps the attachment flap 41. The lateral margins 105, 107 can be glued, or otherwise sealed or attached, together along substantially the entire lateral width of the liner 7. The attachment flap 41 can be glued, or otherwise attached, to the back panel 37, forming a sleeve, which can be folded along the lateral fold lines 27, 33, 39, 45 to separate the front and back panels 23, 37 so that the sleeve is in a generally open-ended tubular form.

The end of the liner 7 adjacent the second end 69 can be closed by overlapping the portions of the liner 7 adjacent the end flaps 51, 57, 63, 67 and gluing the overlapped portions of the liner to one another to form a substantially air-tight seal. The end flaps 51, 57, 63, 67 can be respectively folded and at least partially overlapped to further close the second end 69. The portions of the liner 7 adjacent the end flaps 49, 55, 61, 65 can be overlapped and glued to form a substantially air-tight seal while the end flaps 49, 55, 65 can be respectively folded and at least partially overlapped to close the first end 68. The mount assembly 61 can be folded along the fold line 73 and the mounting flaps 85, 87, 89 can be glued to the interior or exterior surfaces of the respective front panel 23, back panel 37, and overlapped end flaps 49, 65 to form the obliquely configured upper corner of the carton 4 (FIG. 5). The end flaps can be respectively glued together at the first and second ends 68, 69 to secure the closed ends. The ends of the liner 7 can be sealed by any suitable seal, such as a pinch seal, a fin seal, and/or a fold-over seal. Alternatively, the ends of the liner can be closed without sealing without departing from the scope of the disclosure. Articles (e.g., food products, nonfood products, etc.) can be loaded into the partially erected package 5 after closing either the first end 68, or the second end 69 (e.g., the first end 68 is closed, the articles are loaded into the interior 11 of the carton 5, and the second end 69 is closed). During erection of the package 5, the liner patch 19 helps protect the weakened areas of the inner dispensing feature 17 (e.g., the cut line 97 and the expansion lines 103) from premature tearing or bursting, such as during folding, gluing, sealing, and filling steps of processing the package.

Alternative assembling, loading, and closing steps may be used without departing from the scope of the disclosure. For example, the sleeve can be loaded and closed in an automated process, and/or the ends 68, 69 can be partially closed.

The erected package 5, including the liner 7 disposed within the outer carton 4 formed from the blank 3, is shown in FIG. 5. An optional fitment 81 can be glued and/or otherwise mounted over the mount assembly 61 at the first end 68 of the package 5 as shown in FIG. 6. The optional fitment 81 includes a latchable lid 111 that can pivot about a hinge 113 to open the fitment and reveal the dispenser 13 (FIG. 7).

In the illustrated embodiment, the dispenser 13 can be opened by tearing the outer dispenser panel 91 away from the mount assembly 61 along the tear line 93 and partially or fully removing the outer dispenser panel 91 to open the outer dispensing feature 15. The access feature 95 can facilitate removal of the outer dispenser panel 61, such as by helping to initiate tearing of the tear line 93. If the liner patch 19 is affixed to the outer dispenser panel 91 as described above, the liner patch 19 is pealed away from the liner 7 as the outer dispenser panel 91 is pulled away from the outer carton 4. Additionally, the inner dispenser panel 99 remains attached to the liner patch 19 and separates from the liner 7. Accordingly, the dispenser 13 is easily opened by a user in a single step. Alternatively, the dispenser 13 can be opened in a two-step process where the outer dispenser panel 91 is not affixed to the liner patch 19 as described above. In the two-step opening process, the outer dispenser panel 91 is removed to form an outer opening 115 in the outer carton 4 and to reveal the outer surface of the liner patch 19. Information can optionally be printed on the liner patch 19, such as logos, product information, coupons, instructions for opening the inner dispensing feature 17 and liner patch 19 (e.g., an arrow pointing to an opening tab, not shown, that is free of adhesive as described above, or an indication of a hinged edge of the liner patch 19 as described above), and instructions for resealing the liner patch 19 to the liner 7 (such as if a pressure sensitive adhesive is used to attach the liner patch to the liner).

As shown in FIG. 7, the dispenser 13 can be further opened in the two-step process by pealing the liner patch 19 away from the liner 7. The inner dispenser panel 99 remains attached to the liner patch 19 and is separated from remainder of the liner 7 along the cut line 97 as the liner patch 19 is pulled away from the liner 7, thereby forming an inner dispenser opening 117. The two-step opening process for the dispenser 13 can be advantageous for providing additional confidence that the barrier of the liner 7 is intact when a user opens the dispenser (i.e., tamper-evident packaging). With the dispenser 13 at least partially removed, the contents of the package 5 can be removed, such as by pouring the contents through the opening 101 (e.g., the inner dispenser opening 117 and the outer dispenser opening 115). In the case that the sealing portion 100 of the liner 7 includes one or more expansion lines 103 (FIG. 4A), the inner dispenser opening 117 is an initial dispenser opening, and portions of the liner 7 adjacent the initial dispenser opening can be separated along the expansion lines 103 to expand the inner dispenser opening in the liner. The carton can be opened by alternative opening steps without departing from this disclosure.

The package 5 could be otherwise shaped, arranged, and/or configured without departing from the disclosure. The package 5 could include various handle features for carrying the carton and could include various alternative dispenser features for opening the package. Further the outer carton 4 could include other panel/flap closing configurations without departing from the disclosure.

The carton 4 is shown and described by way of example. Alternatively, the inner dispensing feature 17 and liner patch 19 can be incorporated into a liner for any suitable carton style having any suitable panel configuration and can be configured to be aligned with any suitable outer dispensing feature configuration. For example, the inner dispensing feature and liner patch can be aligned with an outer dispensing feature extending in one or more of the front, back, and side panels of a carton and/or one or more of the end flaps of the carton. Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a product, the package comprising:

a carton comprising a plurality of panels at least partially enclosing an interior of the carton;

a liner at least partially positioned in the interior of the carton, the liner comprising an inner dispensing feature, the inner dispensing feature comprising an inner dispenser panel at least partially defined b a separating line in the liner and the liner comprising a sealing portion adjacent the separating line, the separating line comprising a cut line, the inner dispenser panel being at least partially separated from the sealing portion of the liner along the cut line; and a liner patch overlapping the inner dispensing feature, and the liner patch being mounted on the liner for facilitating opening of the inner dispensing feature.

2. The package of claim 1, wherein the separating line comprises a tear line, the inner dispenser panel being separable from the sealing portion of the liner along the tear line.

3. The package of claim 1, wherein the inner dispenser panel is generally rectangular, the separating line extending around the perimeter of the inner dispenser panel.

4. The package of claim 1, wherein the liner patch is adhered to at least a portion of the inner dispenser panel, and the liner patch overlaps at least a portion of the separating line.

5. The package of claim 4, wherein the liner patch is adhered to at least a portion of the sealing portion of the liner, the liner patch being separable from the sealing portion of the liner.

6. The package of claim 1, wherein the carton further comprises an outer dispensing feature that is generally aligned with the liner patch and the inner dispensing feature.

7. The package of claim 6, wherein the outer dispensing feature comprises an outer dispenser panel at least partially defined by a tear line extending in at least one panel of the plurality of panels, the outer dispenser panel at least partially overlapping the liner patch.

8. The package of claim 7, wherein the separating line of the inner dispensing feature is spaced apart from the tear line of the outer dispensing feature along a length of the separating line and the tear line.

9. The package of claim 7, wherein:

the at least one panel is respectively foldably connected to a side panel of the plurality of panels and a plurality of attachment flaps along a plurality of fold lines; and the separating line of the inner dispensing feature is spaced apart from the plurality of fold lines.

10. The package of claim 9, wherein the tear line of the outer dispensing feature comprises at least one segment that is collinear with a fold line of the plurality of fold lines.

11. The package of claim 9, wherein the inner dispensing feature comprises at least one expansion line extending from the separating line in the sealing portion of the liner toward the tear line in the outer dispensing feature, the liner patch overlapping the at least one expansion line.

12. The package of claim 1, wherein the liner comprises a first material and the liner patch comprises a second material, the first material and the second material being different materials.

13. The package of claim 1, wherein the dispensing feature of the liner comprises an opening in the liner and the liner comprises a sealing portion extending around the opening, the liner patch being releasably adhered to at least a portion of the sealing portion of the liner.

14. A package for holding a product, the package comprising:

a carton comprising a plurality of panels at least partially enclosing an interior of the carton;

a liner at least partially positioned in the interior of the carton, the liner comprising an inner dispensing feature, the inner dispensing feature comprising an inner dispenser panel at least partially defined by a separating line in the liner, and the liner comprising a sealing portion adjacent the separating line;

a liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and wherein a first portion of the liner patch is pivotably attached to the sealing portion of the liner, and a second portion of the liner patch is adhered to the sealing portion of the liner by a resealable adhesive.

15. A package for holding a product, the package comprising:

a carton comprising a plurality of panels at least partially enclosing an interior of the carton;

a liner at least partially positioned in the interior of the carton, the liner comprising an inner dispensing feature, the inner dispensing feature comprising an inner dispenser panel at least partially defined by a separating line in the liner, the liner comprising a sealing portion adjacent the separating line;

a liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and the liner patch is adhered to the inner dispenser panel by a first adhesive and is adhered to the sealing portion by a second adhesive, the first adhesive forming a stronger bond between the liner patch and the inner dispenser panel than a bond fanned by the second adhesive between the liner patch and the sealing portion of the liner.

16. A package for holding a product, the package comprising:

a carton comprising a plurality of panels at least partially enclosing an interior of the carton;

a liner at least partially positioned in the interior of the carton, the liner comprising an inner dispensing feature, the inner dispensing feature comprising an inner dispenser panel at least partially defined by a separating line in the liner, and the liner comprising a sealing portion adjacent the separating line a liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and the liner patch is adhered to the inner dispenser panel by a first adhesive and is adhered to the sealing portion by a second adhesive, the first adhesive being substantially the same as the second adhesive.

17. A package for holding a product, the package comprising:

a carton comprising a plurality of panels at least partially enclosing an interior of the carton;

a liner at least partially positioned in the interior of the carton, the liner comprising an inner dispensing feature, the inner dispensing feature comprising an inner dispenser panel at least partially defined by a separating line in the liner, and the liner comprising a sealing portion adjacent the separating line;

a liner patch overlapping the inner dispensing feature, and the liner patch being mounted on the liner for facilitating opening of the inner dispensing feature; and wherein the liner patch overlaps the sealing portion of the liner, and the inner dispensing feature comprises at least one expansion line extending from the separating line in the sealing portion of the liner, wherein removal of the inner dispenser panel forms an initial opening and portions of the sealing portion can be separated at the at least one expansion line to expand the initial opening after the opening of the inner dispensing feature.

18. A package for holding a product, the package comprising:

a carton comprising a plurality of panels at least partially enclosing an interior of the carton;

a liner at least partially positioned in the interior of the carton, the liner comprising an inner dispensing feature; and a liner patch overlapping the inner dispensing feature, and the liner patch being mounted on the liner for facilitating opening of the inner dispensing feature; and wherein the liner comprises a first material and the liner patch comprises a second material, the first material and the second material being different materials, and the second material comprises a plurality of layers, the plurality of layers comprising at least a laser stop layer for controlling a laser cut depth when forming the separating line in the liner.

19. The package of claim 18, the laser stop layer of the second material comprising at least one of a foil layer, an ink layer, and a dye layer.

20. In combination, a carton blank, a liner, and a liner patch for forming a package for holding a product, the carton blank comprising a plurality of panels respectively foldably connected to one another;

the liner being mounted on at least one panel of the plurality of panels, the liner comprising an inner dispensing feature, the inner dispensing feature comprising an inner dispenser panel at least partially defined by a separating line in the liner, and the liner comprising a sealing portion adjacent the separating line, the separating line comprising a cut line, the inner dispenser panel being at least partially separated from the sealing portion of the liner along the cut line; and the liner patch overlapping the inner dispensing feature, and the liner patch being mounted on the liner for facilitating opening of the inner dispensing feature.

21. The combination of claim 20, wherein the separating line comprises a tear line, the inner dispenser panel being separable from the sealing portion of the liner along the tear line.

22. The combination of claim 20, wherein the inner dispenser panel is generally rectangular, the separating line extending around the perimeter of the inner dispenser panel.

23. The combination of claim 20, wherein the liner patch is adhered to at least a portion of the inner dispenser panel, and the liner patch overlaps at least a portion of the separating line.

24. The combination of claim 23, wherein the liner patch is adhered to at least a portion of the sealing portion of the liner, the liner patch being separable from the sealing portion of the liner.

25. The combination of claim 20, wherein the carton blank further comprises an outer dispensing feature that is generally aligned with the liner patch and the inner dispensing feature.

26. The combination of claim 25, wherein the outer dispensing feature comprises an outer dispenser panel at least partially defined by a tear line extending in at least one panel of the plurality of panels, the outer dispenser panel at least partially overlapping the liner patch.

27. The combination of claim 26, wherein:

the at least one panel is respectively foldably connected to a side panel of the plurality of panels and a plurality of attachment flaps along a plurality of fold lines; and the separating line of the inner dispensing feature is spaced apart from the plurality of fold lines.

28. The combination of claim 27, wherein the inner dispensing feature comprises at least one expansion line extending from the separating line in the sealing portion of the liner toward the tear line in the outer dispensing feature, the liner patch overlapping the at least one expansion line.

29. The combination of claim 20, wherein the liner comprises a first material and the liner patch comprises a second material, the first material and the second material being different materials.

30. The combination of claim 20, wherein the dispensing feature of the liner comprises an opening in the liner and the liner comprises a sealing portion extending around the opening, the liner patch being releasably adhered to at least a portion of the sealing portion of the liner.

31. In combination, a carton blank, a liner, and a liner patch for forming a package for holding a product, the carton blank comprising a plurality of panels respectively foldably connected to one another;

the liner being mounted on at least one panel of the plurality of panels, the liner comprising an inner dispensing feature, the inner dispensing feature comprising an inner dispenser panel at least partially defined by a separating line in the liner, and the liner comprising a sealing portion adjacent the separating line;

the liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and wherein a first portion of the liner patch is pivotably attached to the sealing portion of the liner, and a second portion of the liner patch is adhered to the sealing portion of the liner by a resealable adhesive.

32. In combination, a carton blank, a liner, and a liner patch for forming a package for holding a product, the carton blank comprising a plurality of panels respectively foldably connected to one another;

the liner being mounted on at least one panel of the plurality of panels, the liner comprising an inner dispensing feature, the inner dispensing feature comprising an inner dispenser panel at least partially defined by a separating line in the liner, and the liner comprising a sealing portion adjacent the separating line;

the liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and the liner patch is adhered to the inner dispenser panel by a first adhesive and is adhered to the sealing portion by a second adhesive, the first adhesive forming a stronger bond between the liner patch and the inner dispenser panel than a bond formed by the second adhesive between the liner patch and the sealing portion of the liner.

33. In combination, a carton blank, a liner, and a liner patch for forming a package for holding a product, the carton blank comprising a plurality of panels respectively foldably connected to one another;

the liner being mounted on at least one panel of the plurality of panels, the liner comprising an inner dispensing feature, the inner dispensing feature comprising an inner dispenser panel at least partially defined by a separating line in the liner, and the liner comprising a sealing portion adjacent the separating line;

the liner patch overlapping the inner dispensing feature, and the liner patch being mounted on the liner for facilitating opening of the inner dispensing feature; and wherein the liner patch is adhered to at least a portion of the inner dispenser panel and the sealing portion of the liner, and the liner patch overlaps at least a portion of the separating line, the liner patch being separable from the sealing portion of the liner, and the liner patch is adhered to the inner dispenser panel by a first adhesive and is adhered to the sealing portion by a second adhesive, the first adhesive being substantially the same as the second adhesive.

34. In combination, a carton blank, a liner, and a liner patch for forming a package for holding a product, the carton blank comprising a plurality of panels respectively foldably connected to one another;

the liner being mounted on at least one panel of the plurality of panels, the liner comprising an inner dispensing feature, the inner dispensing feature comprising an inner dispenser panel at least partially defined by a separating line in the liner, and the liner comprising a sealing portion adjacent the separating line;

the liner patch overlapping the inner dispensing feature, and the liner patch being mounted on the liner for facilitating opening of the inner dispensing feature; and wherein the liner patch overlaps the sealing portion of the liner, and the inner dispensing feature comprises at least one expansion line extending from the separating line in the sealing portion of the liner, wherein removal of the inner dispenser panel forms an initial opening and portions of the sealing portion can be separated at the at least one expansion line to expand the initial opening after the opening of the inner dispensing feature.

35. A method of forming a package, the method comprising:

forming a package comprising a liner, a liner patch mounted on the liner, and a carton comprising a plurality of panels, the forming the package comprising:

mounting the liner patch to the liner;

forming an inner dispensing feature in the liner, the forming the inner dispensing feature comprising forming an inner dispenser panel in a portion of the liner that is overlapped by the liner patch, the forming the inner dispensing feature comprising forming a cut line in the liner, the cut line generally extends through the liner and defines an inner dispenser panel in the liner, and the liner patch generally forms a seal over the cut line; and forming an interior of the carton at least partially defined by the plurality of panels, the liner being at least partially positioned in the interior of the carton.

36. The method of claim 35, wherein the forming the inner dispensing feature further comprises forming at least one expansion line in the liner, the at least one expansion line extends from the cut line, and the liner patch overlaps the at least one expansion line.

37. The method of claim 36, wherein the mounting the liner patch to the liner comprises pivotally attaching a first portion of the liner patch to the liner and adhering at least a second portion of the liner patch to the liner.

38. A method of opening a package, the method comprising:

obtaining a package comprising a carton comprising a plurality of panels at least partially enclosing an interior of the carton, a liner at least partially positioned in the interior of the carton, the liner comprising an inner dispensing feature, and a liner patch mounted on the liner and overlapping the inner dispensing feature, the inner dispenser opening comprising an initial inner dispenser opening, the liner comprising an expansion line extending from the initial inner dispenser opening;

forming an inner dispenser opening in the inner dispensing feature of the liner by at least partially removing the liner patch from the liner; and expanding the initial inner dispenser opening by tearing a portion of the liner along the expansion line.

39. The method of claim 38, wherein the carton comprises an outer dispensing feature comprising an outer dispenser panel that is generally aligned with the liner patch and the inner dispensing feature, and the method further comprises forming an outer dispenser opening by at least partially removing the outer dispenser panel.

40. The method of claim 38, wherein the liner patch is mounted on the liner by an adhesive, and the method further comprises resealing at least a portion of the liner patch to the liner with the adhesive after the forming the inner dispenser opening.

41. The method of claim 38, wherein the inner dispenser feature comprises an inner dispenser panel at least partially defined by a separating line in the liner, the liner patch is adhered to at least the inner dispenser panel, and the removing at least a portion of the liner patch removes at least a portion of the inner dispenser panel from the liner.

* * * * *